US005433060A

United States Patent [19]

Gur et al.

[11] Patent Number: 5,433,060

[45] Date of Patent: Jul. 18, 1995

[54] AUTOMATED METHOD AND APPARATUS FOR DETACHABLY SECURING FLEXIBLE PACKAGES TO A DISPLAY STRIP

[75] Inventors: Ali Gur, Istanbul, Turkey; Thomas E. Bown, Dallas, Tex.

[73] Assignee: Recot, Inc., Plano, Tex.

[21] Appl. No.: 194,354

[22] Filed: Feb. 10, 1994

[51] Int. Cl.[6] ..... B65B 61/14; B65B 29/04

[52] U.S. Cl. ..... 53/413; 53/134.1; 53/551; 53/451

[58] Field of Search ..... 53/450, 451, 550, 551, 53/552, 591, 410, 413, 128.1, 134.1, 374.8, 134.2, 136.1, 415; 156/552, 299, 302, 297

[56] References Cited

U.S. PATENT DOCUMENTS

| | | | |
|---|---|---|---|
| 2,272,623 | 2/1942 | Runner . | |
| 2,379,935 | 7/1945 | Seiferth et al. . | |
| 2,802,321 | 8/1957 | Abbott . | |
| 2,968,137 | 1/1961 | De Mallie . | |
| 3,331,182 | 7/1967 | Hannon . | |
| 3,432,982 | 3/1969 | Brinkmeier et al. . | |
| 3,565,728 | 2/1971 | Alton . | |
| 4,002,003 | 1/1977 | Place et al. . | |
| 4,003,782 | 1/1977 | Farrelly . | |
| 4,093,493 | 6/1978 | Welch et al. | 156/552 |
| 4,106,261 | 8/1978 | Greenwalt | 53/450 |
| 4,422,552 | 12/1983 | Palmer et al. . | |
| 4,476,619 | 10/1984 | Palmer . | |
| 4,807,420 | 2/1989 | Barker | 53/550 |
| 4,899,520 | 2/1990 | Lerner et al. | 53/374.8 |
| 5,109,648 | 5/1992 | Evans | 53/138.2 |
| 5,269,116 | 12/1993 | Roberts et al. | 53/134.1 |
| 5,335,479 | 8/1994 | Lemke et al. | 53/451 |

*Primary Examiner*—Lowell A. Larson
*Assistant Examiner*—Rodney Butler
*Attorney, Agent, or Firm*—Rothwell, Figg, Ernst & Kurz

[57] ABSTRACT

A method and apparatus for removably securing flexible packages to a display carrier strip so that the packages can be removed therefrom without damaging the sealed condition of the packages. The apparatus includes sealing jaws which form transverse seals on a package preform that is separated into two packages. The sealing jaws have attached to the underside thereof sealing blocks which carry sealing elements that heat-seal the display carrier strip to the top of each filled sealed package simultaneously with the forming of the transverse seals by the sealing jaws. The attachment of the packages to the carrier strip is greatly simplified compared with prior art attachment systems.

19 Claims, 4 Drawing Sheets

AUTOMATED METHOD AND APPARATUS FOR DETACHABLY SECURING FLEXIBLE PACKAGES TO A DISPLAY STRIP

BACKGROUND OF THE INVENTION

1 Field of the Invention

The present invention relates generally to systems for affixing packages to a carrier strip and, more particularly, to a method and apparatus for detachably securing flexible packages to a display carrier strip and simultaneously forming a sealed end of each package.

2. Description of Background Art

It is known in the art to form flexible packages of various products, e.g., snack food products, and affix the packages to a carrier strip which may be displayed in a grocery store or the like. The customer can remove a package from the carrier without damaging the package, i.e., without adversely affecting the sealed condition of the package. One of the primary attributes of such display strip systems is their suitability for use in a retail establishment with limited space. The display strips are considerably smaller than conventional product display racks, which racks may not fit in particular establishments due to space limitations or may not be justified in view of limited sales volume. The display strip and attached packages require little space and may be positioned on a counter or other suitable support.

Palmer U.S. Pat. No. 4,422,552 et al. and Palmer U.S. Pat. No. 4,476,619 disclose methods and apparatus for folding the end seal or flange of a bag into the slot of a display card. The steps of folding and tucking the end seals of numerous packages into a slotted display card are often performed manually and consume considerable time and expense. The prior art, however, includes alternative methods of attaching flexible packages to a display card.

For example, Runner U.S. Pat. No. 2,272,623 discloses a display card with packages removably attached thereto by adhesive. In Farfelly U.S. Pat. No. 4,003,782, manufactured bags are applied to two lines of pressure sensitive adhesive and then stored in a carton or the like. It is also known to attach empty packages to a display or mounting support base and then fill and seal the packages. See Hannon U.S. Pat. No. 3,331,182. Several problems arise with the aforementioned methods of securing packages to a display strip. One problem that often occurs when the packages are adhesively attached to the display strip is that the packages cannot easily be removed from the strip without damaging the sealed condition of the packages. Additional problems arose in attempts to automate the attachment of the carrier strip to the flexible packages due to the limited space available below the sealing jaws of a conventional bagmaking apparatus. In other words, there was little or no room below the seal jaws to accommodate automatic attachment equipment.

It is apparent that there is a need in the art for a method and apparatus for removably securing flexible packages to a display strip which are free of the problems present in prior art systems.

SUMMARY OF THE INVENTION

The present invention provides a method and apparatus for detachably securing flexible packages to a display carrier strip while simultaneously sealing an end of each package. In its preferred form, the present invention includes a novel sealing jaw assembly which permits the display carrier strip to be fed therethrough into close proximity with the package preform. The sealing jaws place a transverse seal in the package preform which forms the top seal of a filled package extending below the jaws, and the bottom seal of an empty package extending above the jaws. The top seal of the filled package is detachably secured to the carrier display strip simultaneously with the forming of the transverse seal. The continuous display strip and attached packages then may be transported by a suitable conveyor device to a packaging area or the like and prepared for shipment.

BRIEF DESCRIPTION OF THE DRAWINGS

Additional features and advantages of the present invention will become apparent from the following detailed description taken in conjunction with the accompanying drawings wherein.

DETAILED DESCRIPTION OF THE PREFERRED EMBODIMENTS

Figure 1:
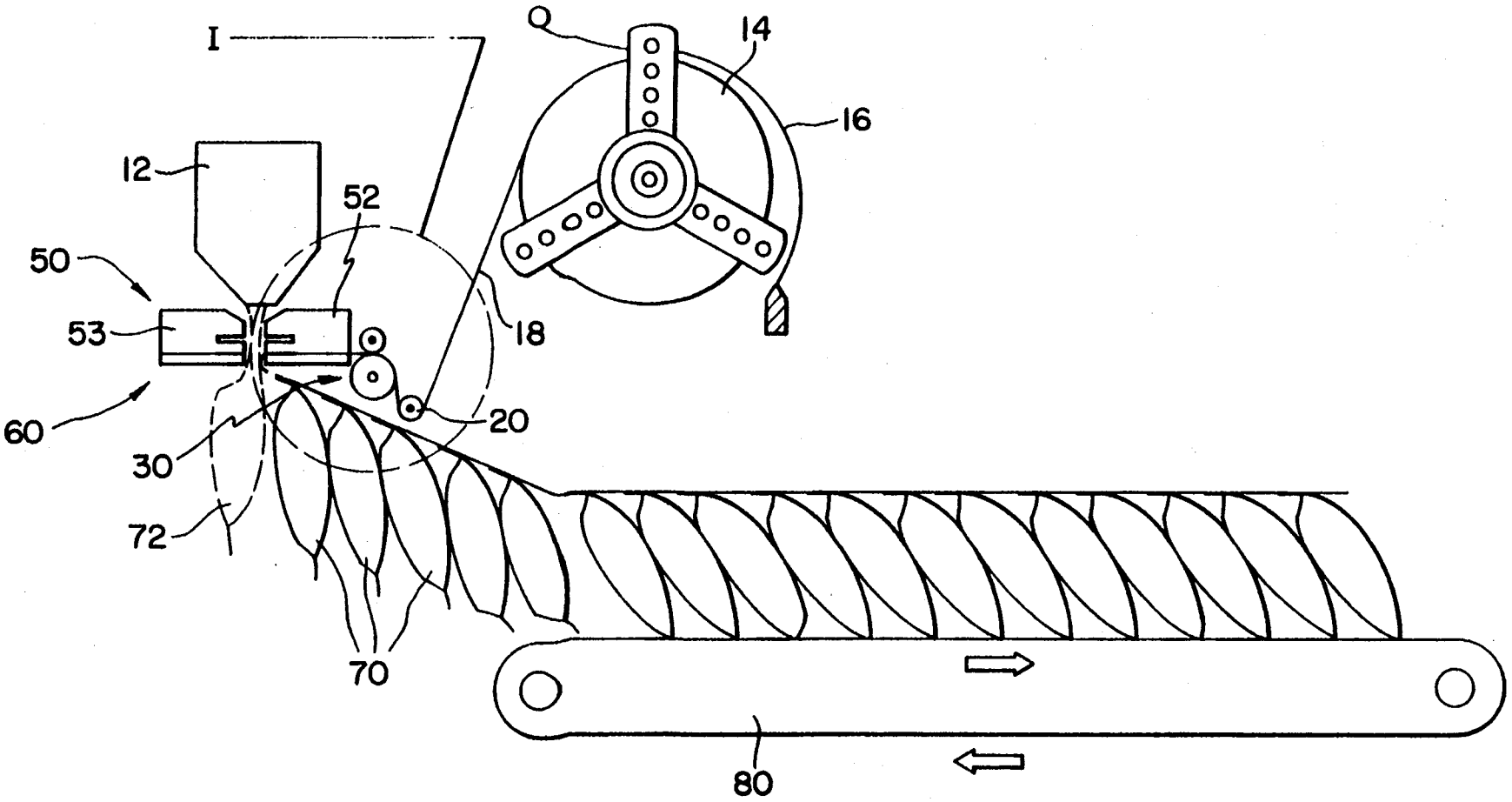
FIG. 1 is a somewhat schematic view of an automated assembly apparatus for detachably securing flexible packages to a display strip.

Referring to FIG. 1, an automated apparatus for detachably securing flexible packages to a display strip is indicated generally by the reference numeral 10. A bagmaking apparatus, e.g., a vertical form, fill, and seal apparatus (VFFS), is shown schematically at 12. Bagmaking apparatus such as VFFS machines are known in the art and will not be described in detail in the present application.

Bagmaking apparatus 12 forms packaging material into package preforms which are advanced in consecutive fashion through the apparatus 12. In particular, a preform is transversely sealed by sealing jaws at a sealing station disposed below the filling tube of the bagmaking apparatus. The seal constitutes the top edge of a filled package extending below the sealing station and the bottom edge of a yet to be filled package extending above the sealing station. A knife mechanism cuts the preform at-the transverse seal to separate same into two separate packages; the lower package being filled and sealed at both ends and the upper package being empty and sealed at its lower end. After separating the packages by cutting the transverse seal on the preform, the empty package is advanced and filled to bring its top edge to the sealing station where it is sealed and separated from the next package, i.e., the package now extending above the sealing station.

Figure 2A:
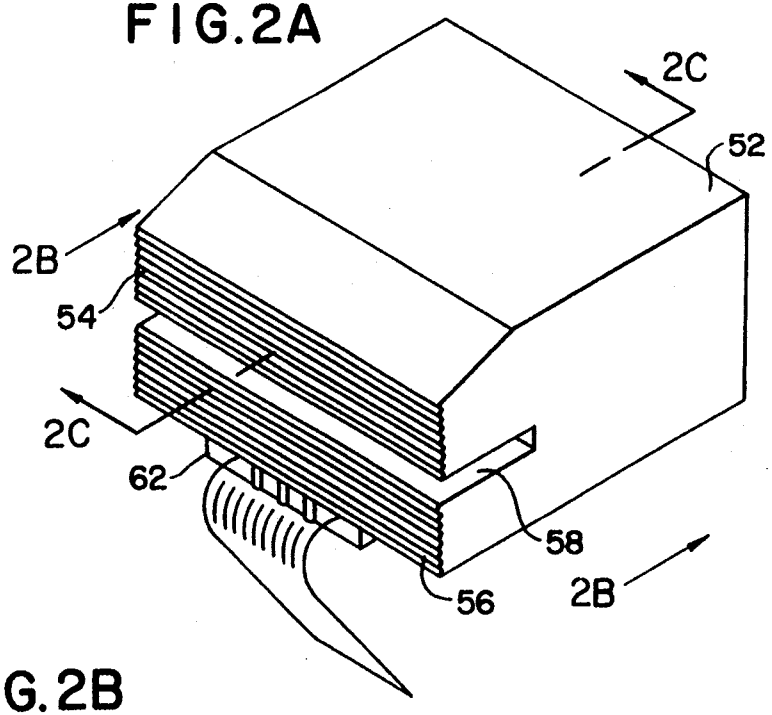
FIG. 2A is a perspective view of a sealing jaw according to the present invention.
Figure 2C:
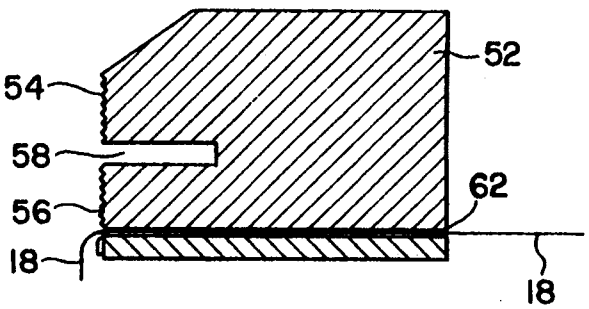
FIG. 2C is a sectional view of the sealing jaw shown in FIG. 2A looking in the direction of arrows c—c in FIG. 2A.
Figure 2B:
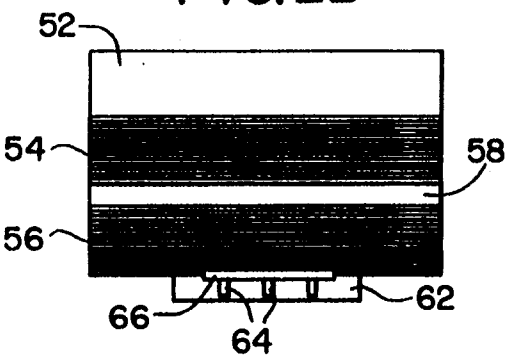
FIG. 2B is an end elevation view of the sealing jaw shown in FIG. 2A looking in the direction of arrows b—b in FIG. 2A.

The sealing station is indicated generally at 50 in FIG. 1 and includes sealing jaws 52, 53 for forming the aforementioned transverse seals. A lower sealing assembly for removably attaching the packages to the display strip is indicated generally at 60 in FIG. 1 and includes lower sealing blocks or bars 62, 63. As best seen in FIGS. 2A–2C, lower sealing blocks or bars 62, 63 preferably are respectively secured to sealing jaws 52, 53. Sealing jaw 52 has a cut-out portion 66 which defines a slot 68 extending through the jaw for reasons that will be described below.

Figure 4A:
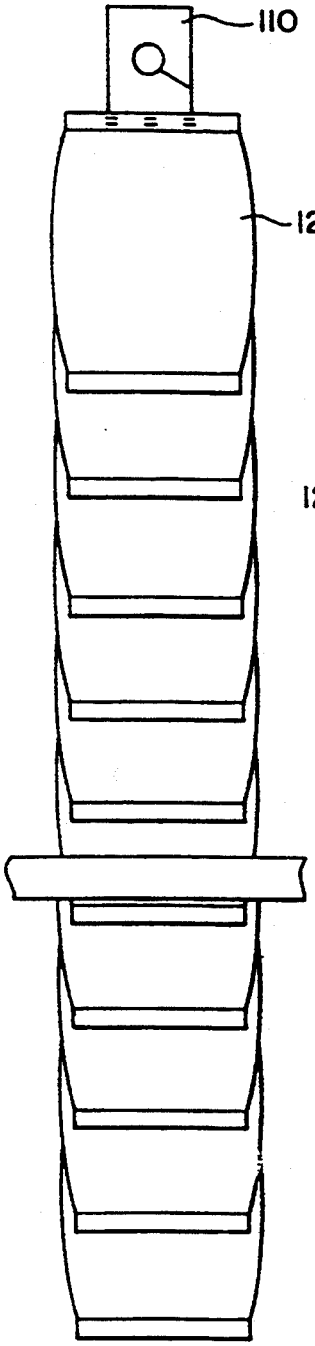
FIG. 4A is a front elevational view of the finished display strip and attached packages.

With attention directed to FIG. 1, a supply reel 14 of display carrier strip material has a strip web 18 extending therefrom toward bagmaking apparatus 12. A reel friction brake 16 controls the speed of rotating supply reel 14. The display carrier strip is preferably manufactured from a material that is flexible but yet stiff enough to support a plurality of packages as seen in FIG. 4A which shows the final product. The display strip material is selected so that it does not melt and/or deform before the attachment of the packages to the strip, i.e, as the strip is fed through the sealing jaw which typically reaches 375° F. during operation. For example, the display carrier strip may be manufactured from suitable plastic materials, such as paper laminated to coextruded metallized polyethylene to 40 micron polypropylene.

The carrier strip web 18 passes from supply reel 14 to a strip drive mechanism indicated generally at reference numeral 30 and enclosed in circle I in FIG. 1. The strip drive mechanism 30 advances carrier web 18 in a controlled manner relative advancement of the package preforms. The strip drive mechanism 30 can be any device which suitably advances the carrier strip web 18 through the sealing station 50, 60.

Figure 3B:
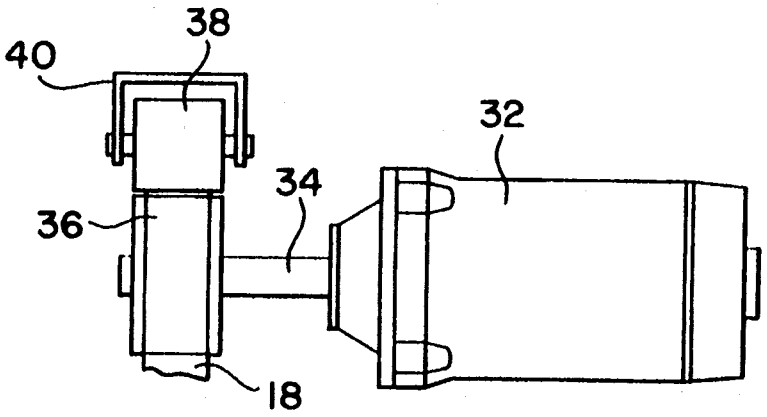
FIG. 3B is a front elevational view of the portion shown in FIG. 3 looking in the direction of arrows a in FIG. 3.
Figure 3A:
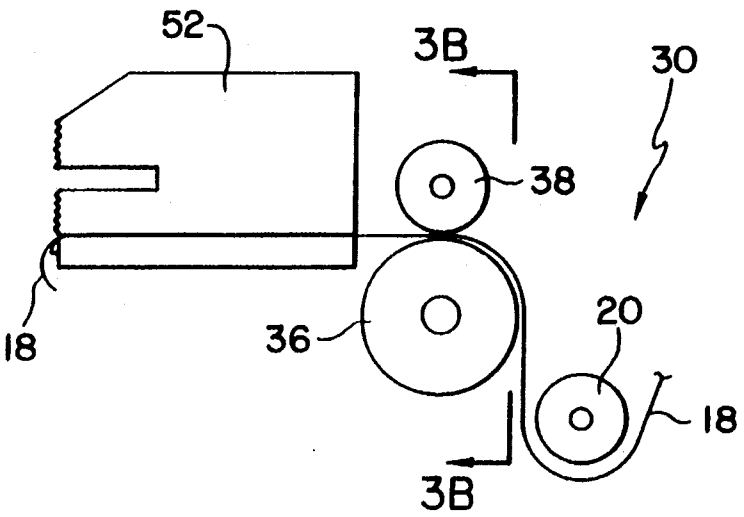
FIG. 3A is an enlarged view of the encircled portion in FIG. 1.
Figure 4B:
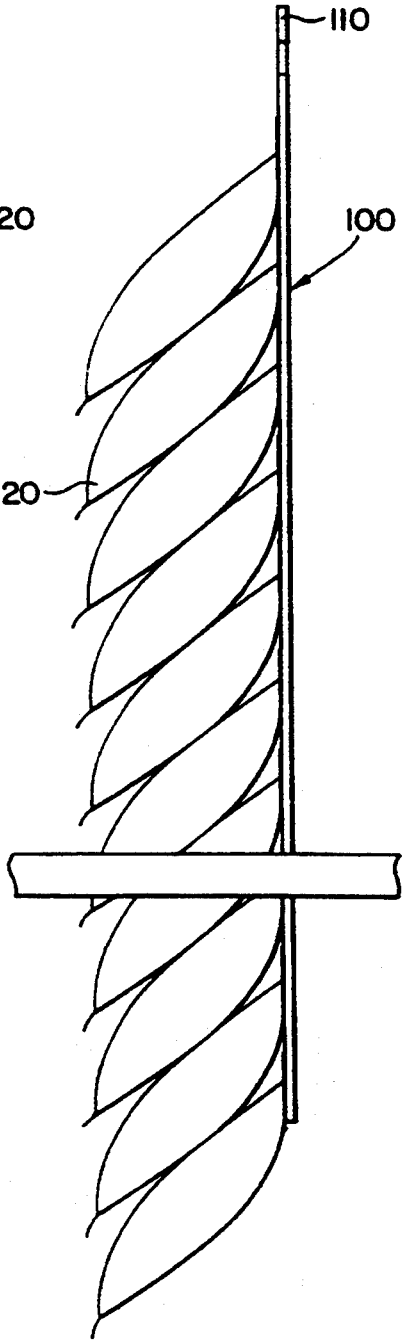
FIG. 4B is a side elevational view of the display strip and attached packages shown in FIG. 3A.

The circled portion I of FIG. 1 is enlarged in FIGS. 4A and 4B and shows a preferred embodiment of a strip drive mechanism 30 that includes a stepper motor 32 having a shaft 34 which drives a stepper wheel 36. The stepper wheel 36 rotates to advance strip web 18 into an elongated slot formed in sealing jaw 52 as described in detail below. A back-up roller 38 is disposed next to stepper wheel 36 and the strip web 18 passes between the back-up roller 38 and the stepper wheel 36. The back-up roller 38 may be rotatably mounted on a bracket 40 as shown in FIG. 3B. The stepper motor can be precisely controlled to permit the carrier strip web to be properly positioned relative the package preforms advanced by the bagmaking apparatus. In addition, the strip drive mechanism 30 can be programmed such that the stepper motor 32 will be automatically controlled, e.g., by a microprocessor. The stepper wheel preferably includes a rubber wheel having, e.g., a 2 inch diameter and a 3 inch width. The rubber wheel frictionally engages the strip material web 18 and cooperates with back-up roller 38 to advance the web.

Those skilled in the art will recognize, of course, that means for advancing the carrier strip web other than the above-described stepper motor may be used. For example, an air cylinder device which advances the strip web with air powered mechanical movements may be used in lieu of the stepper motor mechanism.

With attention directed to FIGS. 2A—2C, sealing jaw 52 of sealing station 50 and sealing block 62 of lower sealing assembly 60 are shown therein in detail. Sealing jaw 52 includes an upper sealing portion 54 and a lower sealing portion 56 separated by a groove 58. The groove 58 extends a limited distance from adjacent the outer surface of sealing portions 54, 56 into the interior of sealing jaw 52. See FIG. 2C. Groove 58 preferably contains a knife mechanism (not shown) which severs the package preform into a lower filled package and an upper empty package as described above. Specifically, upper sealing portion 54 forms the lower transverse seal of the upper package and lower sealing portion 56 forms the upper transverse seal of the filled lower package. After the knife mechanism separates the packages, the upper package, the bottom edge of which now has been sealed, may be filled and advanced downward, wherein further actuation of the sealing jaws 52, 53 seals the top of the same package.

The present invention attaches the filled sealed packages to the display strip 18 simultaneously with the forming of transverse seals as described above. Attached to the sealing jaws 52, 53 by any suitable means are, respectively, sealing blocks 62, 63 of lower sealing assembly 60. As seen in FIGS. 1 and 2C, display carrier web 18 passes from take-up spool 20, past strip drive mechanism 30, through sealing jaw 52, and into engagement with the package. For this purpose, sealing jaw 52 is provided with an elongated slot 68 extending therethrough. A cut-out portion 66 of sealing jaw 52 cooperates with sealing block 62 to define slot 68. In particular, sealing block 62 preferably is secured to sealing jaw 52 so as to cover cut-out portion 66. See FIG. 2B. Sealing block 62 also preferably has a width that is slightly greater than the width of cut-out portion 55 but less than the overall width of sealing jaw 52.

Lower sealing blocks 62, 63 have mating seal elements 64 disposed thereon as best seen in FIGS. 2A and 2B. The sealing elements 64 of each block 62, 63 are aligned so as to engage each other when the sealing jaws 52, 53 are brought together. The display carrier strip web 18 passes into slot 68 of sealing jaw 52 and then downward from the slot over the sealing elements 64 of sealing block 62. See FIGS. 1, 2A and 2C. This positions the display carrier strip 18 in close proximity with the unsealed top edge of a filled package 72, shown in phantom in FIG. 1. In addition to sealing the top edge of the filled package 72 (and the bottom edge of an overlying empty package), actuation of the sealing jaws 52, 53 detachably secures the top edge of filled package 72 to the display carrier strip 18.

Lower sealing blocks 62, 63 preferably have a plurality of sealing elements 64 disposed thereon which secure the filled package to the display carrier strip 18 at locations corresponding to the position and number of sealing elements 64. In a preferred embodiment, three sealing elements 64 are included on each sealing block 62, 63. However, those skilled in the art will recognize that different numbers and configurations of sealing elements may be used without departing from the present invention.

Sealing blocks 62, 63 heat-seal the top edge of the filled package to the display carrier strip 18 upon actuation of the sealing jaws 52, 53. The sealing elements 64 securely affix the package to the strip 18 such that the package may be easily removed from the carrier strip without damaging the sealed condition of the filled, sealed package. The material from which display carrier strip 18 is formed adheres to the packaging material by point heat and pressure applied by sealing blocks 62, 63. Thus, the actuating motion of sealing jaws 52, 53 seals the top edge of the filled package and seals the package to the display carrier strip. This arrangement greatly simplifies the overall procedure and is a significant improvement over prior art systems.

The carrier strip 18, with the filled, sealed packages 70 attached thereto, is carried by a conveyor mechanism 80 to a location where the strip and packages are prepared for distribution. The flexibility of the display carrier strip permits the same to be case packed with the packages attached thereto for easy storage and/or transportation.

Figure 4C:
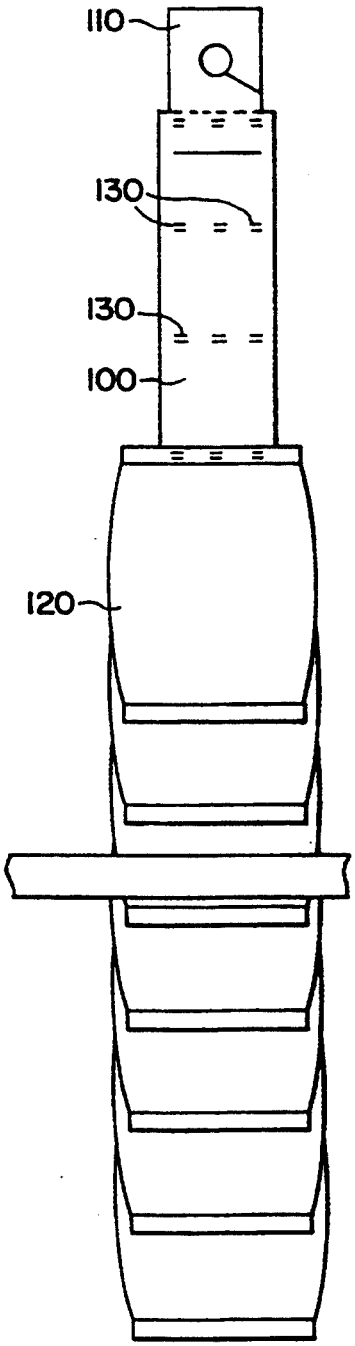
FIG. 4C is a front elevational view of the display strip and attached packages shown in FIG. 3A with some of the packages removed.

FIGS. 4A–4C show a display strip produced according to the present invention and having a plurality of packages secured thereto in removable fashion. The display carrier strip 100 includes an adhesive hanger member 110 which serves to secure the entire assembly to a suitable support surface. Of course, any other support or hanger means may be used. The strip 100 has packages 120 removably attached thereto by heat seal connections 130 formed by the strip seal bars or blocks 62, 63 as described above. FIGS. 4A and 4B show a display carrier strip 100 fully covered with packages 120. FIG. 4C shows the product display strip of FIGS. 4A and 4B with several packages removed. The releasable heat seal connections 130, which permit removal of the packages 120 without damaging their sealed condition, are visible on the portion of the display carrier strip 100 from which packages have been removed.

It is apparent that the method and apparatus of the present invention permit the removable attachment of filled, sealed flexible packages to a display carrier strip without the problems present in prior art systems. The attachment of the packages to the display carrier strip is carried out using the existing motion of the sealing jaws which form the top and bottom edge seals of each package. A precisely controlled strip drive mechanism cooperates with the sealing jaws to eliminate prior art problems in package control and positioning. Moreover, the attachment mechanism for securing the packages to the carrier strip is greatly simplified over prior art systems. Consequently, the present invention significantly reduces manufacturing cost compared with conventional package attachment systems.

Other features and advantages of the present invention will readily occur to those skilled in the art, as will many modifications and alterations in the preferred embodiments of the invention described herein, all of which may be achieved without departing from the spirit and the scope of the invention as defined by the appended claims.

What is claimed is:

1. An apparatus for manufacturing a plurality of sealed packages which packages are all detachably secured one after another to a single display carrier strip, the apparatus comprising:

a bagmaking device for forming a package preform, the preform configured to receive product;

a sealing station disposed adjacent said bagmaking device, the sealing station including movable sealing jaws for forming a transverse heat seal across the preform to form a top seal of a filled package extending below the sealing station and a bottom seal of a package to be filled extending above the sealing station;

a strip drive device for feeding a continuous carrier display strip to a location adjacent the sealing station; and at least one strip seal bar, the at least one strip seal bar being mounted for movement with the sealing jaws and defining an opening adjacent one of the sealing jaws for positioning the carrier strip adjacent the package, the strip seal bar detachably securing an end of each package to the single carrier display strip simultaneously with the sealing of an end of the package by the sealing jaws;

whereby filled sealed packages are all secured to the single carrier display strip and can be removed therefrom without damaging the sealed condition of the packages.

2. An apparatus according to claim 1, wherein said sealing station includes a pair of sealing jaws for forming the top and bottom seals of adjacent packages and a pair of strip seal bars for detachably securing the packages to the carrier strip.

3. An apparatus according to claim 2, wherein one of the two sealing jaws includes a slot extending therethrough and the carrier strip passes through the slot in the one sealing jaw to a location adjacent an end of a package.

4. An apparatus according to claim 3, wherein the slot extending through the one sealing jaw is defined between one of the strip seal bars and a cut-out portion of the one sealing jaw.

5. An apparatus according to claim 3, wherein a first strip seal bar is secured to a first sealing jaw and a second strip seal bar is secured to a second sealing jaw, and wherein activation of the sealing jaws to form the transverse package seal activates the seal bars to removably secure a package to the display carrier strip.

6. An apparatus according to claim 1, wherein the at least one strip seal bar is one of a plurality of mating seal elements.

7. An apparatus according to claim 1, wherein the strip drive device includes a stepper motor and a stepper wheel, and the stepper motor rotates the stepper wheel to controllably advance the display carrier strip web toward the sealing station.

8. An apparatus for manufacturing a plurality of sealed packages which are detachably secured to a single display carrier strip, the apparatus comprising:

means for forming a package preform configured to receive product;

a sealing station disposed below said means for forming the package preform, the sealing station including means for forming a transverse seal across the preform to form a top seal of a filled package extending below the sealing station and a bottom seal of a package to be filled extending above the sealing station;

means for feeding a continuous carrier display strip to a location adjacent said seal-forming means;

means for detachably securing an end of each package to the single continuous carrier display strip simultaneously with the sealing of an end of the package such that the packages are secured to the single continuous carrier display strip one package after another package; and means for separating adjacent preforms along the transverse seal to form the bottom and top seals of packages extending, respectively, above and below the sealing station;

whereby the packages are secured to the carrier strip so as to be selectively removable therefrom without damaging the sealed condition of the packages.

9. An apparatus according to claim 8, wherein said seal-forming means includes a pair of sealing jaws for forming the top and bottom seals of adjacent packages.

10. An apparatus according to claim 8, wherein the strip drive device includes a stepper motor which rotates a stepper wheel for frictionally engaging and advancing the display carrier strip web toward the sealing station.

11. An apparatus according to claim 9, wherein one of the sealing jaws of said seal-forming means includes a slot extending therethrough for feeding the carrier strip therethrough and against a package.

12. An apparatus according to claim 11, wherein the sealing jaws of said seal-forming means each include a strip seal bar for detachably securing the carrier strip to the package preform, and wherein activation of the sealing jaws to form a transverse package seal activates the seal bars to removably secure a package to the display carrier strip.

13. An apparatus according to claim 12, wherein the slot extending through the one sealing jaw is disposed between the strip seal bar and a lower portion of the one sealing jaw.

14. A method of manufacturing a plurality of filled, sealed packages which are removably secured to a continuous carrier strip, the method comprising steps of:

forming a series of package preforms each of which is configured to receive product from a product supply source;

positioning a continuous carrier strip adjacent the package preforms;

forming a transverse heat seal across the preform by moving a pair of heated sealing jaws together to form a top seal of a filled package extending below the sealing station and a bottom seal of a package to be filled extending above the sealing station;

simultaneously with moving the heated pair of sealing jaws together to form the top seal of the filled package, detachably securing the top of the filled package to the carrier strip by moving the top of the filled package against the display carrier strip and removably joining the top seal of the filled package to the carrier strip; and repeatedly forming the top transverse seal of adjacent filled packages to detachably secure the plurality of filled packages to the display carrier strip.

15. A method according to claim 14, wherein the pair of heated sealing jaws have a portion which simultaneously detachably secures an end of the filled package to the carrier strip.

16. A method according to claim 15, wherein one sealing jaw includes an opening through which the carrier strip is be passed into close proximity with the package preform and detachably secured thereto by the sealing jaws.

17. A method according to claim 16, wherein the sealing jaws each include a heated strip seal block which detachably secures the carrier strip to the package preform, and wherein activation of the sealing jaws to form a transverse package seal simultaneously activates the heated strip seal blocks to removably heat seal a package to the carrier strip.

18. A method according to claim 16, wherein the step of positioning a continuous carrier strip adjacent the package preform is carried out by a strip drive device which includes a stepper motor and a stepper wheel, and the stepper motor rotates the stepper wheel to advance the carrier strip web through the opening in the one sealing jaw and toward the sealing station.

19. A sealing apparatus for sealing an end of a package preform and simultaneously securing the package preform to a carrier strip, the apparatus comprising:

a sealing assembly including a pair of sealing jaws for sealing an end of a package preform disposed between the sealing jaws, wherein one of the sealing jaws defines an opening passing through the one jaw through which a carrier strip is fed into close proximity with the package preform; and at least one carrier strip sealing element for detachably securing the package preform to the carrier strip fed through the opening simultaneously with the sealing of the end of the package preform by the pair of sealing jaws;

whereby a filled sealed package formed from the preform may be removed from the strip without damaging the sealed condition of the package.

* * * * *